US010993048B2

(12) United States Patent
Boldt et al.

(10) Patent No.: US 10,993,048 B2
(45) Date of Patent: Apr. 27, 2021

(54) SPEECH INTELLIGIBILITY-BASED HEARING DEVICES AND ASSOCIATED METHODS

(71) Applicant: GN HEARING A/S, Ballerup (DK)

(72) Inventors: Jesper B. Boldt, Ballerup (DK); Charlotte Sørensen, Ballerup (DK); Rene Burmand Johannesson, Ballerup (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 15/974,028

(22) Filed: May 8, 2018

(65) Prior Publication Data

US 2019/0132688 A1 May 2, 2019

(30) Foreign Application Priority Data

May 9, 2017 (EP) ..... 17170175

(51) Int. Cl.
*H04R 25/00* (2006.01)

(52) U.S. Cl.
CPC ..... *H04R 25/505* (2013.01); *H04R 25/43* (2013.01); *H04R 25/554* (2013.01);
(Continued)

(58) Field of Classification Search
CPC ..... G10L 21/00; G10L 21/02; G10L 21/0202; G10L 21/0205; G10L 21/0208; G10L 21/0364; G10L 21/057; G10L 15/20; G10L 25/84; G06F 17/27; G06F 3/16; G06F 3/162; G06F 3/165; G06F 3/167;
(Continued)

(56) References Cited

U.S. PATENT DOCUMENTS 9,031,838 B1 * 5/2015 Nash ..... G10L 25/69 704/200
9,064,502 B2 6/2015 Taal et al.
(Continued)

FOREIGN PATENT DOCUMENTS

CN 103813252 A 5/2014

OTHER PUBLICATIONS

Foreign Office Action dated Oct. 28, 2020 for Chinese Appln. No. 201810437256.7.

*Primary Examiner* — Andrew C Flanders
(74) *Attorney, Agent, or Firm* — Vista IP Law Group, LLP

(57) ABSTRACT

A hearing device includes: an antenna for receiving a first wireless input signal from an external device and providing an antenna output signal; a transceiver configured to provide a transceiver input signal; an input module for provision of a first input signal, the input module comprising a first microphone; a processor; a receiver configured to provide an audio output signal; a pre-processor for provision of a pre-processor output signal based on the first input signal; and a controller comprising a speech intelligibility estimator for determining a speech intelligibility indicator indicative of speech intelligibility based on the transceiver input signal and a first controller input signal, wherein the controller is configured to provide a controller output signal based on the speech intelligibility indicator; wherein the pre-processor is configured to apply, based on the controller output signal, a pre-processing scheme to the first input signal and/or the transceiver input signal.

35 Claims, 7 Drawing Sheets

(52) U.S. Cl.
CPC ..... *H04R 25/604* (2013.01); *H04R 2225/43* (2013.01); *H04R 2225/51* (2013.01)

(58) Field of Classification Search
CPC .. H04R 25/505; H04R 25/43; H04R 2225/43; H04R 25/554; H04R 25/00; H04R 25/35; H04R 25/353; H04R 25/356; H04R 25/48; H04R 25/50; H04R 25/502; H04R 25/55; H04R 25/552; H04R 2225/51; H04R 3/00; H04R 3/005; H04R 3/12; H04R 2430/00; H04R 29/00; H04R 29/004; H04R 29/005
See application file for complete search history.

(56) References Cited

U.S. PATENT DOCUMENTS 9,271,089 B2 2/2016 Suzuki et al.
10,225,669 B2 3/2019 Jensen et al.
2003/0064746 A1* 4/2003 Rader ..... H04R 25/70 455/550.1
2003/0152243 A1* 8/2003 Julstrom ..... H04R 25/43 381/315
2005/0195996 A1* 9/2005 Dunn ..... H03G 3/3026 381/105
2005/0260978 A1* 11/2005 Rader ..... H04R 25/70 455/418
2006/0126859 A1* 6/2006 Elberling ..... G10L 21/0208 381/71.1
2010/0098262 A1* 4/2010 Frohlich ..... H04R 25/70 381/60
2010/0299148 A1* 11/2010 Krause ..... G10L 25/48 704/237
2011/0224976 A1* 9/2011 Taal ..... G10L 25/69 704/205
2013/0142345 A1* 6/2013 Waldmann ..... H04R 25/70 381/56
2015/0199977 A1* 7/2015 Ungstrup ..... H04R 25/55 704/260
2017/0256269 A1* 9/2017 Jensen ..... G10L 21/0232

* cited by examiner

SPEECH INTELLIGIBILITY-BASED HEARING DEVICES AND ASSOCIATED METHODS

RELATED APPLICATION DATA

This application claims priority to, and the benefit of, European Patent Application No. 17170175.8 filed on May 9, 2017, pending. The entire disclosure of the above application is expressly incorporated by reference herein.

FIELD

The present disclosure relates to a hearing device, and a method of operating a hearing device.

BACKGROUND

External microphones, such as spouse microphones, are getting increasingly used in hearing systems for improving the experience of the hearing device user. This trend is also supported by the widespread use of wireless communications technology in hearing systems.

EP 2 840 807 A1 describes an external microphone array configured to be used with a hearing aid. The microphone array comprises a number of microphones configured to detect one or more sound signals from a sound source and means for wirelessly sending the detected sound signal to at least one hearing aid.

However, the use of external microphone still poses challenges to hearing device processing and does not always improve the hearing experience of the user, such as the intelligibility of the speech and of the acoustic environment.

SUMMARY

Accordingly, there is a need for hearing devices, methods and hearing systems that overcome drawbacks of the background.

A hearing device is disclosed, comprising an antenna for converting a first wireless input signal from an external device to an antenna output signal. The hearing device comprises a radio transceiver coupled to the antenna for converting the antenna output signal to a transceiver input signal. The hearing device comprises an input module for provision of a first input signal, the input module comprising a first microphone. The hearing device comprises a processor for processing input signals and providing a processor output signal based on input signal. The hearing device comprises a receiver for converting an output signal based on the processor output signal to an audio output signal. The hearing device comprises a pre-processor, operatively connected to the input module and to the radio transceiver, for provision of a pre-processor output signal based on the first input signal and the transceiver input signal. The hearing device comprises a controller, operatively connected to the radio transceiver, the controller comprising a speech intelligibility estimator for estimating a speech intelligibility indicator indicative of speech intelligibility based on the transceiver input signal and a first controller input signal, wherein the controller is configured to provide a controller output signal based on the speech intelligibility indicator. The pre-processor is configured to apply, based on the controller output signal, a pre-processing scheme to at least one of the first input signal and the transceiver input signal.

Further, this disclosure relates to a method of operating a hearing device. The method may be performed in a hearing device or in a hearing system. The method comprises receiving a first wireless input signal from an external device and converting the first wireless input signal to a transceiver input signal. The method comprises receiving an audio signal and converting the audio signal to one or more input signals including a first input signal. The method comprises estimating a speech intelligibility indicator indicative of speech intelligibility based on the transceiver input signal and a first controller input signal. The method comprises providing a controller output signal based on the speech intelligibility indicator, and applying, based on the controller output signal, a pre-processing scheme to at least one of the first input signal and the transceiver input signal.

It is an advantage of the present disclosure that it allows, at the hearing device, to measure the speech intelligibility based on received signals and/or (pre-) processed signals and control the processing of the input signals based the speech intelligibility measured. The present disclosure provides an adaptive processing of the input signals based on the speech intelligibility. In particular, the present disclosure improves accuracy of the estimation of the speech intelligibility and enhances the processing of the input signals.

A hearing device includes: an antenna for receiving a first wireless input signal from an external device, the antenna configured to provide an antenna output signal based on the first wireless input signal; a transceiver coupled to the antenna, the transceiver configured to provide a transceiver input signal based on the antenna output signal; an input module for provision of a first input signal, the input module comprising a first microphone; a processor configured to provide a processor output signal; a receiver configured to provide an audio output signal based on the processor output signal; a pre-processor, operatively connected to the input module and to the transceiver, for provision of a pre-processor output signal based on the first input signal; and a controller, operatively connected to the transceiver, the controller comprising a speech intelligibility estimator for determining a speech intelligibility indicator indicative of speech intelligibility based on the transceiver input signal and a first controller input signal, wherein the controller is configured to provide a controller output signal based on the speech intelligibility indicator; wherein the pre-processor is configured to apply, based on the controller output signal, a pre-processing scheme to the first input signal, to the transceiver input signal, or to both of the first input signal and the transceiver input signal.

Optionally, the first controller input signal is the first input signal.

Optionally, the first controller input signal is the pre-processor output signal.

Optionally, the first controller input signal is the processor output signal.

Optionally, the speech intelligibility estimator is configured to determine the speech intelligibility indicator by comparing the transceiver input signal and the first controller input signal.

Optionally, the speech intelligibility estimator is configured to compare the transceiver input signal and the first controller input signal based on a modulation of the transceiver input signal and a modulation of the first controller input signal.

Optionally, the speech intelligibility estimator is configured to compare the transceiver input signal and the first controller input signal based on a correlation between one or more spectral and/or temporal representations of the transceiver input signal and one or more spectral and/or temporal representations of the first controller input signal.

Optionally, the speech intelligibility estimator is configured to determine the speech intelligibility indicator using a short-time objective intelligibility estimator, wherein the short-time objective intelligibility estimator is configured to compare the transceiver input signal and the first controller input signal in one or more short time segments.

Optionally, the controller is configured to determine the pre-processing scheme based on the speech intelligibility indicator.

Optionally, the controller is configured to determine the pre-processing scheme by determining one or more first gain parameter(s) of the pre-processing scheme and one or more second gain parameter(s) of the pre-processing scheme.

Optionally, the pre-processor is configured to apply the pre-processing scheme by applying the one or more first gain parameter(s) to the first input signal, and applying the one or more second gain parameter(s) to the transceiver input signal.

Optionally, the one or more first gain parameter(s) comprise a first set of filter coefficients, and the one or more second gain parameter(s) comprise a second set of filter coefficients.

Optionally, the controller is configured to determine the one or more first gain parameter(s) and the one or more second gain parameter(s) based on the speech intelligibility indicator.

Optionally, the controller is configured to determine the speech intelligibility indicator for one or each of a plurality of frequency bands, and generate one or more first frequency dependent gain parameter(s) and one or more second frequency dependent gain parameter(s) based on the speech intelligibility indicator for the one or each of the plurality of frequency bands.

Optionally, the external device is a spouse microphone device, and wherein the transceiver input signal is a speech sound signal from the spouse microphone device.

Optionally, the pre-processor is configured for provision of the pre-processor output signal based also on the transceiver input signal.

A method performed by a hearing device includes: receiving, by an antenna, a first wireless input signal from an external device; providing, by a transceiver, a transceiver input signal based on the first wireless input signal; receiving an audio signal by an input module; providing one or more input signals by the input module, the one or more input signals comprise a first input signal; determining a speech intelligibility indicator indicative of speech intelligibility based on the transceiver input signal and a first controller input signal; providing a controller output signal based on the speech intelligibility indicator; and applying, based on the controller output signal, a pre-processing scheme to the first input signal, to the transceiver input signal, or to both.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
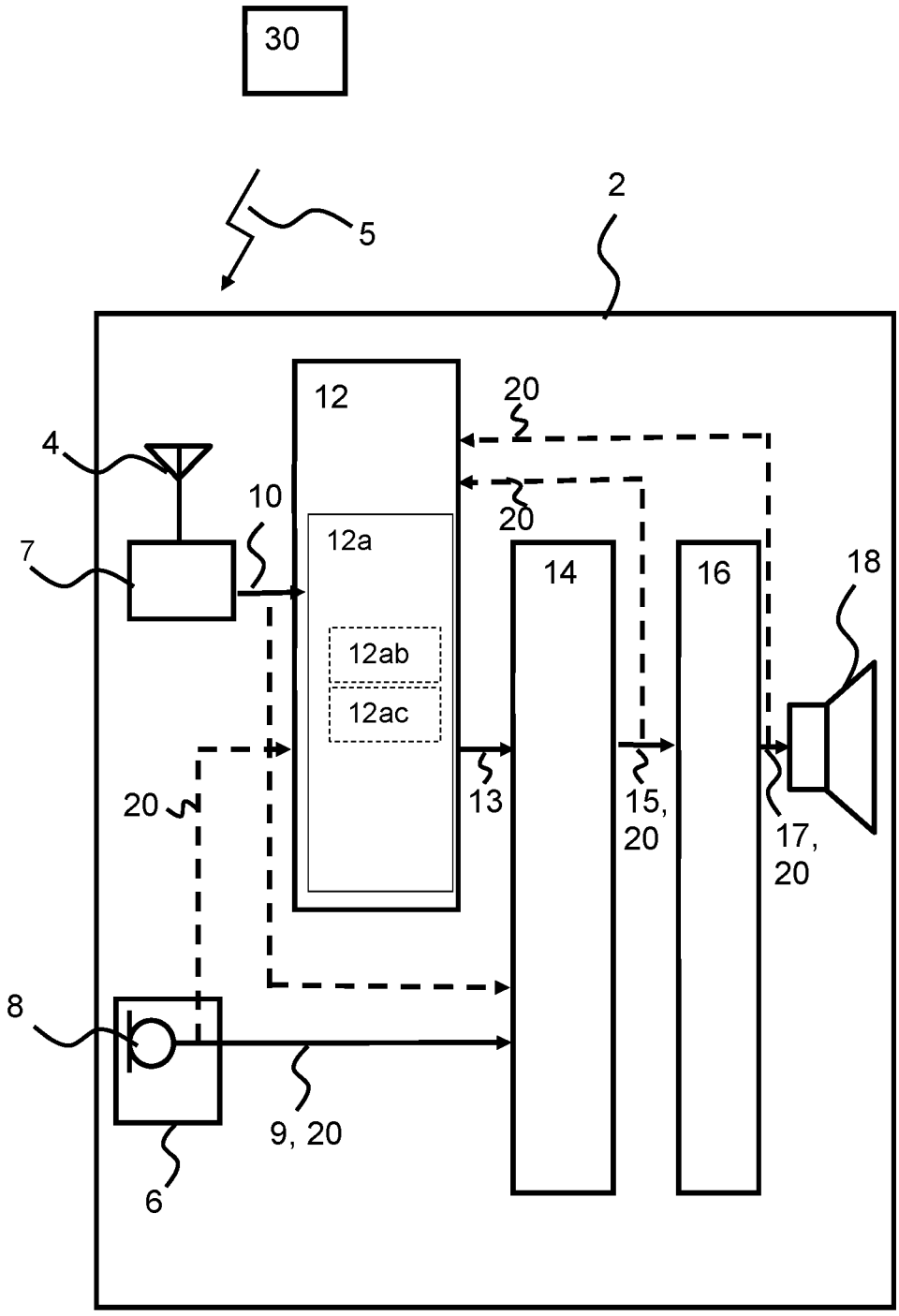
FIG. 1 schematically illustrates an exemplary hearing device according to the disclosure, FIG. 2 schematically illustrates an exemplary hearing device according to the disclosure, wherein the first controller input signal is a first input signal, FIG. 3 schematically illustrates an exemplary hearing device according to the disclosure, wherein the first controller input signal is a pre-processor output signal, FIG. 4 schematically illustrates an exemplary hearing device according to the disclosure, wherein the first controller input signal is a processor output signal.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

When an external microphone, e.g. a spouse microphone, is used, the mixture of the wireless signal from the external microphone and the sound signal from the hearing device microphones is usually a fixed and predetermined value. For example, the sound signal captured by the hearing device microphones are attenuated by the same value, e.g. 6 dB, independently from the user need or the acoustic environment. It has been realized by the inventors that when the sound signals from the acoustic environment are at moderate levels, there is no need to attenuate the hearing aid microphones with 6 dB. Conversely, in severe cocktail party situations, 6 dB attenuation of the hearing aid microphones may not be sufficient. Too much attenuation of the hearing aid microphones may lead the hearing-impaired person losing the connection to the acoustic environment while too little attenuation of the hearing aid microphones may lead to the streamed sound being unintelligible. Both situations are unfavourable as they lead to the isolation for the hearing aid user.

An alternative is to let user control and adjust the mixing levels, which is cumbersome and may also not lead to an optimal hearing experience.

The inventors have discovered that an intelligibility estimation may be beneficial for the user of a hearing device such that the processing of the sound signal from the hearing device microphones can be controlled based on the assessed speech intelligibility. Thus, the inventors have found the following benefits in using a speech intelligibility indicator to optimize the processing of sound signals in the hearing device: pre-processing input signal with optimal processing schemes (leading to e.g. attenuation input signals with an optimal level), and enabling the user to connect to the acoustic environmental while still understanding the speech from an external device.

Further, the inventors have discovered that the intelligibility estimation may benefit from exploiting the received signals (e.g. transceiver input signal, first input signal) and/or processed signals (e.g. pre-processor output signal, processor output signal).

EP 2 840 807 A1 is silent on speech intelligibility.

A hearing device is disclosed herein. The hearing device may be a hearing aid, wherein the processor is configured to compensate for a hearing loss of a user. The hearing device may be a hearing aid, e.g. of a behind-the-ear (BTE) type, in-the-ear (ITE) type, in-the-canal (ITC) type, receiver-in-canal (RIC) type or receiver-in-the-ear (RITE) type.

The hearing device may be a cochlear implant. The present disclosure is applicable to a cochlear implant comprising a processor and a receiver, wherein the processor is configured to provide wired or wirelessly a processor output signal to the receiver, and wherein the receiver is configured to convert the processor output signal into an electrical impulse.

The hearing device comprises an antenna for converting one or more wireless input signals, e.g. a first wireless input signal and optionally a second wireless input signal, to an antenna output signal. The wireless input signal(s) origin from external device(s), such as a spouse microphone device(s) (also called a partner microphone device(s)), a wireless TV audio transmitter, and/or a distributed microphone array associated with a wireless transmitter. The external device is a device capable of wirelessly transmitting a signal indicative of sound to the hearing device. For example, the external device may be a spouse microphone device, a wireless TV audio transmitter, and/or a distributed microphone array associated with a wireless transmitter. It may be envisaged that the external device comprises a personal computer (such as a portable personal computer), a table microphone device, another hearing device, a television, and/or a lightbulb microphone device.

The hearing device comprises a radio transceiver coupled to the antenna for converting the antenna output signal to a transceiver input signal. Wireless signals from different external sources may be multiplexed in the radio transceiver to a transceiver input signal or provided as separate transceiver input signals on separate transceiver output terminals of the radio transceiver. The hearing device may comprise a plurality of antennas and/or an antenna may be configured to be operate in one or a plurality of antenna modes. The transceiver input signal may comprise a first transceiver input signal representative of the first wireless signal from a first external device. The transceiver input signal may be for example a sound signal streamed from the external device to the hearing device via the antenna and the radio receiver. In other words, the transceiver input signal may comprise a streamed sound signal. The streamed sound signal comprises substantially and primarily a speech sound. Optionally, it may be envisaged that the antenna is configured to receive one or more additional wireless input signals from one or more additional external devices and that the radio transceiver is configured to provide one or more additional transceiver input signals. The additional external devices may comprise a first additional external device, a second additional external device, a third additional external device etc.

The hearing device comprises an input module for provision of a first input signal, the input module comprising a first microphone of a set of microphones. The input signal is for example an acoustic sound signal processed by a microphone. The set of microphones may comprise one or more microphones. The set of microphones comprises a first microphone for provision of a first input signal and/or a second microphone for provision of a second input signal. The set of microphones may comprise N microphones for provision of N microphone signals, wherein N is an integer in the range from 1 to 10. In one or more exemplary hearing devices, the number N of microphones is two, three, four, five or more. The set of microphones may comprise a third microphone for provision of a third input signal.

The hearing device comprises a processor for processing input signals, such as microphone input signal(s). The processor is configured to provides a processor output signal based on the input signals to the processor. The processor may be configured to compensate for a hearing loss of a user.

The hearing device comprises a receiver for converting the processor output signal to an audio output signal. The receiver may be configured to convert the processor output signal to an audio output signal to be directed towards an eardrum of the hearing device user.

The hearing device comprises a pre-processor, operatively connected to the input module and to the radio transceiver, for provision of a pre-processor output signal based on the first input signal and the transceiver input signal.

The hearing device comprises a controller. The controller may be operatively connected to the radio transceiver. The controller may be operatively connected to the pre-processor. Optionally, the controller may be operatively connected to input module and to the processor. The controller comprises a speech intelligibility estimator for estimating a speech intelligibility indicator indicative of speech intelligibility based on a first controller input signal and the transceiver input signal, such as based on one or more transceiver input signals. The controller may be configured to estimate the speech intelligibility indicator based on the transceiver input signal and the first controller input signal. The controller is configured to provide a controller output signal based on the speech intelligibility indicator estimated by the speech intelligibility estimator.

The pre-processor is configured to apply, based on the controller output signal, a pre-processing scheme to at least one of the first input signal and the transceiver input signal. For example, in one or more exemplary hearing devices, the pre-processor is configured to apply, based on the controller output signal, the pre-processing scheme to the first input signal and the transceiver input signal. Stated differently, the pre-processor may be configured to provide a mixed pre-processor output signal.

In other words, it may be seen that the controller is configured to control the pre-processor based on the controller output signal.

In one or more exemplary hearing devices, the pre-processor comprises the controller. In one or more exemplary hearing devices, the controller is collocated with the pre-processor.

In one or more exemplary hearing devices, the pre-processing scheme comprises a gain control scheme, such as an automatic gain control scheme, and/or a filtering scheme.

In one or more exemplary hearing devices, the first controller input signal is the first input signal. For example, the controller or the speech intelligibility estimator may be configured to estimate the speech intelligibility indicator based on the transceiver input signal and the first input signal. The transceiver input signal may serve as the clean reference signal while the first input signal may serve as the noisy speech signal in the speech intelligibility estimation. It is an advantage of the disclosed technique that a fast and efficient processing of the hearing device signals is obtained.

In one or more exemplary hearing devices, the external device is a spouse microphone device, and the transceiver input signal is a speech sound signal from the spouse microphone device, such as a speech sound signal streamed from the spouse microphone device. The speech sound signal streamed from the spouse microphone device is used in the controller to estimate the speech intelligibility indicator. The streamed speech sound signal is further processed in the pre-processor using a pre-processing scheme selected based on the estimated speech intelligibility indicator to enhance the overall hearing experience of the user.

In one or more exemplary hearing devices, the first controller input signal is the pre-processor output signal. For example, the controller or the speech intelligibility estimator may be configured to estimate the speech intelligibility indicator based on the transceiver input signal and the pre-processor output signal. The transceiver input signal may serve as the clean reference signal while the pre-processor output signal may serve as the noisy speech signal in the speech intelligibility estimation. The pre-processor output signal may be seen as a mixed pre-processor output signal. For example, the mixed pre-processor output signal is a mixture of the first input signal and the transceiver input signal.

In one or more exemplary hearing devices, the first controller input signal is the processor output signal. For example, the controller or the speech intelligibility estimator may be configured to estimate the speech intelligibility indicator based on the transceiver input signal and the processor output signal, e.g. where transceiver input signal may serve as the clean reference signal while the processor output signal may serve as the noisy speech signal in the speech intelligibility estimation. The processor output signal may be seen as a mixed processor output signal.

It is an advantage of the disclosed technique that it results in an increased reliability and precision in estimating the speech intelligibility.

In one or more exemplary hearing devices, the speech intelligibility estimator is configured to estimate the speech intelligibility indicator by comparing the transceiver input signal and the first controller input signal. The transceiver input signal may serve as the clean reference signal (as it originates from the first wireless input signal) while the first controller input signal may serve as the noisy speech signal. For example, the comparison of the transceiver input signal and the first controller input signal (e.g. the first input signal, the pre-processor output signal, or the processor output signal) may be performed in the time domain and/or the frequency domain. The speech intelligibility estimator may be configured to provide the speech intelligibility indicator based on a result of the comparison.

In one or more exemplary hearing devices, the speech intelligibility estimator is configured to compare the transceiver input signal and the first controller input signal based on a modulation of the transceiver input signal and a modulation of the first controller input signal. For example, the modulations of the transceiver input signal and of the first controller input signal (e.g. the first input signal, the pre-processor output signal, or the processor output signal), which represent slow variations in different frequency bands are compared to estimate the speech intelligibility. The modulations of the transceiver input signal and of the first controller input signal may be seen as temporal representations of the transceiver input signal and of the first controller input signal.

In one or more exemplary hearing devices, the speech intelligibility estimator is configured to compare the transceiver input signal and the first controller input signal based on a correlation between one or more spectral and/or temporal representations of the transceiver input signal and one or more spectral and/or temporal representations of the first controller input signal.

For example, the speech intelligibility estimator may be configured to compare the transceiver input signal and the first controller input signal over their complete or entire length using any one of the following techniques: the Articulation Index technique where a weighted sum of normalized signal to noise ratios is calculated across a range of third octave bands, the Speech Intelligibility Index SII technique, the Extended SII technique, the Coherence SII technique which deals with non-linear distortion from clipping, the Speech Transmission Index technique which estimates the intelligibility indicator as a reduction in modulation depth over a range of frequency and modulation bands thought to contribute most to speech intelligibility, the Normalized Covariance Metric technique which estimates the speech intelligibility indicator based on a weighted sum of the covariance between the envelopes of the time-aligned reference and processed first control input signals across all frequency bands, the speech-based Envelope Power Spectrum Model technique which estimates the speech intelligibility indicator as a speech-to-noise envelope power ratio at the output of a modulation filter bank to an ideal observer, the Hearing Aid Speech Perception Index technique, and any variations thereof.

Typically, signals such as the transceiver input signal and the first controller input signal (e.g. the first input signal, the pre-processor output signal, or the processor output signal) have a length in the order of tens of seconds.

In one or more exemplary hearing devices, the speech intelligibility estimator is configured to estimate the speech intelligibility indicator using a short-time objective intelligibility estimator. The short-time objective intelligibility estimator is configured to compare the transceiver input signal and the first controller input signal in one or more short time segments. For example, the short time segments may be in the range of 100-500 ms, such as 200-400 ms, such as 100 ms. It may also be envisaged that the short time segments are below 200 ms, such as below 150 ms, such as 100 ms. The short-time objective intelligibility estimator may be configured to compare the transceiver input signal and the first controller input signal by deriving a correlation coefficient between temporal envelops of the transceiver input signal and the first controller input signal (e.g. the first input signal, the pre-processor output signal, or the processor output signal) in short-time overlapping segments.

In one or more exemplary hearing devices, the controller is configured to determine the pre-processing scheme based on the speech intelligibility indicator. For example, in one or more exemplary hearing devices, the controller is configured to determine the pre-processing scheme based on the speech intelligibility indicator by determining one or more first gain parameters of the pre-processing scheme and one or more second gain parameter of the pre-processing scheme.

In one or more exemplary hearing devices, the controller is configured to provide a controller output signal that reflects the pre-processing scheme, such as parameters of the pre-processing scheme. For example, the controller output signal may comprise the one or more first gain parameters and/or the one or more second gain parameters. It may be envisaged in one or more exemplary hearing devices that the one or more first gain parameters are related to the one or more second gain parameters. For example, the one or more second gain parameters are derivable from the one or more second gain parameters. It may be envisaged that the second gain parameter β and the first gain parameter α are related in that e.g. $\beta=1-\alpha$. For example, it may be envisaged that a first gain parameter α and/or a second gain parameter β are provided to the pre-processor as part of the controller output signal by the controller based on the estimated speech intelligibility indicator.

In one or more exemplary hearing devices, the pre-processor is configured to apply the one or more first gain parameters to the first input signal and the one or more second gain parameters to the transceiver input signal or vice versa. In other words, the speech intelligibility indicator is used to control the gain of the first input signal and of the transceiver input signal.

In one or more exemplary hearing devices, the one or more first gain parameters comprise a broadband first gain and the one or more second gain parameters comprise a broadband second gain. A broadband gain is for example a gain parameter to be applied to at least one of the transceiver input signal and the first input signal across a predetermined frequency band such as an entire frequency band. In one or more exemplary hearing devices, the pre-processor is configured to apply the broadband first gain to the first input signal and the second broadband gain to the transceiver input signal or vice versa.

In one or more exemplary hearing devices, the pre-processor comprises a first filter for filtering the first input signal and a second filter for filtering the transceiver input signal.

In one or more exemplary hearing devices, the one or more first gain parameters comprise a first set of filter coefficients and the one or more second gain parameters comprise a second set of filter coefficients. For example, the controller output signal may comprise the first set of filter coefficients and/or the second set of filter coefficients. For example, the first and/or second filter may be adaptive filters. The pre-processor may be configured to apply a pre-processing scheme that uses the first set of filter coefficients in the first filter and/or the second set of filter coefficients in the second filter.

In one or more exemplary hearing devices, determining the one or more first gain parameters and the one or more second gain parameters based on the speech intelligibility indicator comprises measuring a speech intelligibility indicator in each frequency band, and generating one or more first frequency dependent gain parameters and one or more second frequency dependent gain parameters based on the speech intelligibility indicator measured in each frequency band. The speech intelligibility indicator in each frequency band may be measured using a weighted sum of band audibility functions (e.g. in section 4.7 of the American National Standard ANSI S3.5-1997).

This disclosure relates to a method of operating a hearing device, such as controlling the hearing device, such as controlling the processing of the input signals. The method may be performed in a hearing device or in a hearing system. The method comprises receiving a first wireless input signal from an external device and converting the first wireless input signal to a transceiver input signal and receiving an audio signal and converting the audio signal to one or more input signals including a first input signal.

The method comprises estimating a speech intelligibility indicator indicative of speech intelligibility based on the transceiver input signal and a first controller input signal.

The method comprises providing a controller output signal based on the speech intelligibility indicator.

The method comprises applying, based on the controller output signal, a pre-processing scheme to at least one of the first input signal and the transceiver input signal. In one or more exemplary methods, applying, based on the controller output signal, the pre-processing scheme to at least one of the first input signal and the transceiver input signal comprises applying, based on the controller output signal, the pre-processing scheme to the first input signal and the transceiver input signal.

In one or more exemplary methods, the first controller input signal is the first input signal. For example, estimating the speech intelligibility indicator may be performed based on the transceiver input signal and the first input signal wherein the transceiver input signal may serve as the clean reference signal while the first input signal may serve as the noisy speech signal in the speech intelligibility estimation.

In one or more exemplary methods, the first controller input signal is the pre-processor output signal. For example, estimating the speech intelligibility indicator may be performed based on the transceiver input signal and the pre-processor output signal wherein the transceiver input signal may serve as the clean reference signal while the pre-processor output signal may serve as the noisy speech signal in the speech intelligibility estimation. The pre-processor output signal may be seen as a mixed output signal. In other words, estimating the speech intelligibility indicator may be seen as performed based on the transceiver input signal and the mixed output signal coming from the pre-processor.

In one or more exemplary methods, the first controller input signal is the processor output signal. For example, estimating the speech intelligibility indicator may be performed based on the transceiver input signal and the processor output signal.

In one or more exemplary methods, estimating the speech intelligibility indicator comprises comparing the transceiver input signal and the first controller input signal. For example, comparing the transceiver input signal and the first controller input signal may be performed based on a modulation of the transceiver input signal and a modulation of the first controller input signal. For example, comparing the transceiver input signal and the first controller input signal may comprise determining a correlation between one or more spectral and/or temporal representations of the transceiver input signal and one or more spectral and/or temporal representations of the first controller input signal.

In one or more exemplary methods, comparing the transceiver input signal and the first controller input signal is performed using a short-time objective intelligibility, STOI, estimator, wherein the short-time objective intelligibility estimator is configured to compare the transceiver input signal and the first controller input signal in one or more short time segments. For example, the short time segments may be in the range of 100-500 ms, such as 200-400 ms, such as 100 ms. A segment may comprise one or more frames, each frame having a length between 10-40 ms, such as 25.6 ms. For example, a STOI estimator may process 20-30 frames distributed over one or more segments. For example, comparing the transceiver input signal and the first controller input signal may comprise deriving a correlation coefficient between temporal envelops of the transceiver input signal and the first controller input signal (e.g. the first input signal, the pre-processor output signal, or the processor output signal) in short-time overlapping segments.

It may be envisaged that in one or more exemplary methods, determining a correlation between one or more spectral and/or temporal representations of the transceiver input signal and one or more spectral and/or temporal representations of the first controller input signal is performed using a short-time objective intelligibility.

In one or more exemplary methods, the method comprises determining the pre-processing scheme based on the speech intelligibility indicator. For example, determining the pre-processing scheme based on the speech intelligibility indicator may comprise determining one or more first gain parameters of the pre-processing scheme and one or more second gain parameter of the pre-processing scheme. For example, the one or more first gain parameters may comprise a broadband first gain and the one or more second gain parameters may comprise a broadband second gain.

In one or more exemplary methods, applying, based on the controller output signal, a pre-processing scheme to the first input signal and the transceiver input signal comprises applying the one or more first gain parameters to the first input signal and applying the one or more second gain parameters to the transceiver input signal.

In one or more exemplary methods, applying, based on the controller output signal, a pre-processing scheme to the first input signal and the transceiver input signal comprises filtering the first input signal and filtering the transceiver input signal. For example, filtering the first input signal may be performed at a first filter and filtering the transceiver input signal may be performed at a second filter over vice versa.

In one or more exemplary methods, the one or more first gain parameters comprise a first set of filter coefficients and the one or more second gain parameters comprise a second set of filter coefficients. For example, the controller output signal may comprise the first set of filter coefficients and/or the second set of filter coefficients.

The hearing devices, and methods discloses herein allow a prediction of the speech intelligibility indicator and adaptation of the pre-processing applied to the input signals and to the transceiver input signals according to the estimated speech intelligibility indicator. This provides the advantage of adapting the processing of the transceiver input signal (e.g. the speech sound signal from the one or more external devices/spouse microphone devices) with the input signal (e.g. the acoustic sound signal) from the one or more microphones.

The figures are schematic and simplified for clarity. Throughout, the same reference numerals are used for identical or corresponding parts.

FIG. 1 is a block diagram of an exemplary hearing device 2 according to the disclosure. The hearing device 2 comprises an antenna 4 for converting a first wireless input signal 5 from an external device 30 to an antenna output signal. The hearing device 2 comprises a radio transceiver 7 coupled to the antenna 4 for converting the antenna output signal to a transceiver input signal 10. For example, the transceiver input signal 10 may be seen as a streamed speech sound signal from a spouse microphone device.

The hearing device 2 comprises an input module 6 comprising a first microphone 8. The input module 6 may comprise a set of microphones. The set of microphones comprises a first microphone 8 for provision of a first input signal 9 and/or a second microphone for provision of a second input signal. For example, the first input signal 9 may be seen as an acoustic sound signal.

The hearing device 2 comprises a processor 16 for processing input signals. The processor 16 provides a processor output signal 17 based on the input signals to the processor 14. The processor 16 is configured to compensate for a hearing loss of a user and to provide a processor output signal 17 based on input signals.

The hearing device comprises a receiver 18 for converting the processor output signal 17 to an audio output signal. The receiver 18 converts the processor output signal 17 to an audio output signal to be directed towards an eardrum of the hearing device user.

The hearing device comprises a pre-processor 14. The pre-processor 14 is operatively connected to the input module 6 and to the radio transceiver 7. The pre-processor 14 is configured to provide a pre-processor output signal 15 based on the first input signal 9 and the transceiver input signal 10.

The hearing device comprises a controller 12. The controller 12 is operatively connected to radio transceiver 7. The controller 12 may be operatively connected to the input unit 6, to the pre-processor 14, and/or to the processor 16. The controller 12 is configured to estimate the speech intelligibility indicator indicative of speech intelligibility based on the transceiver input signal 10 and a first controller input signal 20. The first controller input signal 20 may be the first input signal 9. The first controller input signal 20 may be the pre-processor output signal 15. The first controller input signal 20 may be the processor output signal 17. The controller 12 comprises a speech intelligibility estimator 12*a* for estimating a speech intelligibility indicator indicative of speech intelligibility based on the transceiver input signal 10. The controller 12 is configured to provide a controller output signal 13 based on the speech intelligibility indicator estimated by the speech intelligibility estimator 12*a*.

The controller 12 is configured to control the pre-processor 14 based on the controller output signal 13.

The speech intelligibility estimator 12*a* is configured to estimate the speech intelligibility indicator by comparing the transceiver input signal 10 and the first controller input signal 20, which may be the first input signal 9, the pre-processor output signal 15 or the processor output signal 17. Hence, the speech intelligibility estimator 12*a* may comprises a comparator module 12*ab*. The transceiver input signal 10 serves as the clean reference signal (as it originates from the first wireless input signal) while the first controller input signal 20 may serve as the noisy speech signal. The speech intelligibility estimator 12*a* may be configured to compare the transceiver input signal 10 and the first controller input signal 20 based on a modulation of the transceiver input signal 10 and a modulation of the first controller input signal 20. The speech intelligibility estimator 12*a* may be configured to compare the transceiver input signal 10 and the first controller input signal 20 based on a correlation between one or more spectral and/or temporal representations of the transceiver input signal 10 and one or more spectral and/or temporal representations of the first controller input signal 20. The speech intelligibility estimator 12*a* may be configured to estimate the speech intelligibility indicator using a short-time objective intelligibility estimator 12*ac*. The short-time objective intelligibility estimator 12*ac* is configured to compare the transceiver input signal 10 and the first controller input signal 20 in one or more short time segments, such as by deriving a correlation coefficient between temporal envelops of the transceiver input signal 10 and the first controller input signal 20 (e.g. the first input signal 9, the pre-processor output signal 15, or the processor output signal 17) in short-time overlapping segments.

The controller 12 may be configured to determine the pre-processing scheme based on the speech intelligibility indicator. For example, in one or more exemplary hearing devices, the controller is configured to determine the pre-processing scheme based on the speech intelligibility indicator by determining one or more first gain parameters of the pre-processing scheme and one or more second gain parameter of the pre-processing scheme. It may be envisaged that the controller output signal 13 reflects the pre-processing scheme, such as parameters of the pre-processing scheme. For example, the controller output signal 13 may comprise the one or more first gain parameters and/or the one or more second gain parameters.

The pre-processor 14 is configured to apply, based on the controller output signal 13, a pre-processing scheme to at least one of the first input signal 9 and the transceiver input signal 10. In one or more exemplary hearing devices, the pre-processor 14 is configured to apply, based on the controller output signal 13, a pre-processing scheme to the first input signal 9 and the transceiver input signal 10.

In one or more exemplary hearing devices, the pre-processor 14 is configured to apply the one or more first gain parameters to the first input signal 9 and the one or more second gain parameters to the transceiver input signal 10 or vice versa. The one or more first gain parameters may comprise a broadband first gain and the one or more second gain parameters comprise a broadband second gain. The one or more first gain parameters may comprise a first set of filter coefficients and the one or more second gain parameters may comprise a second set of filter coefficients. State differently, the controller output signal 13 may comprise a broadband first gain and/or a broadband second gain. The controller output signal 13 may comprise a first set of filter coefficients and/or a second set of filter coefficients.

In one or more exemplary hearing devices, the controller 12 is configured to determine the one or more first gain parameters and the one or more second gain parameters by measuring a speech intelligibility indicator in each frequency band, and generating one or more first frequency dependent gain parameters and one or more second frequency dependent gain parameters based on the speech intelligibility indicator measured in each frequency band.

In one or more exemplary hearing devices, the set of microphones comprises a second microphone for provision of a second input signal.

Figure 2:
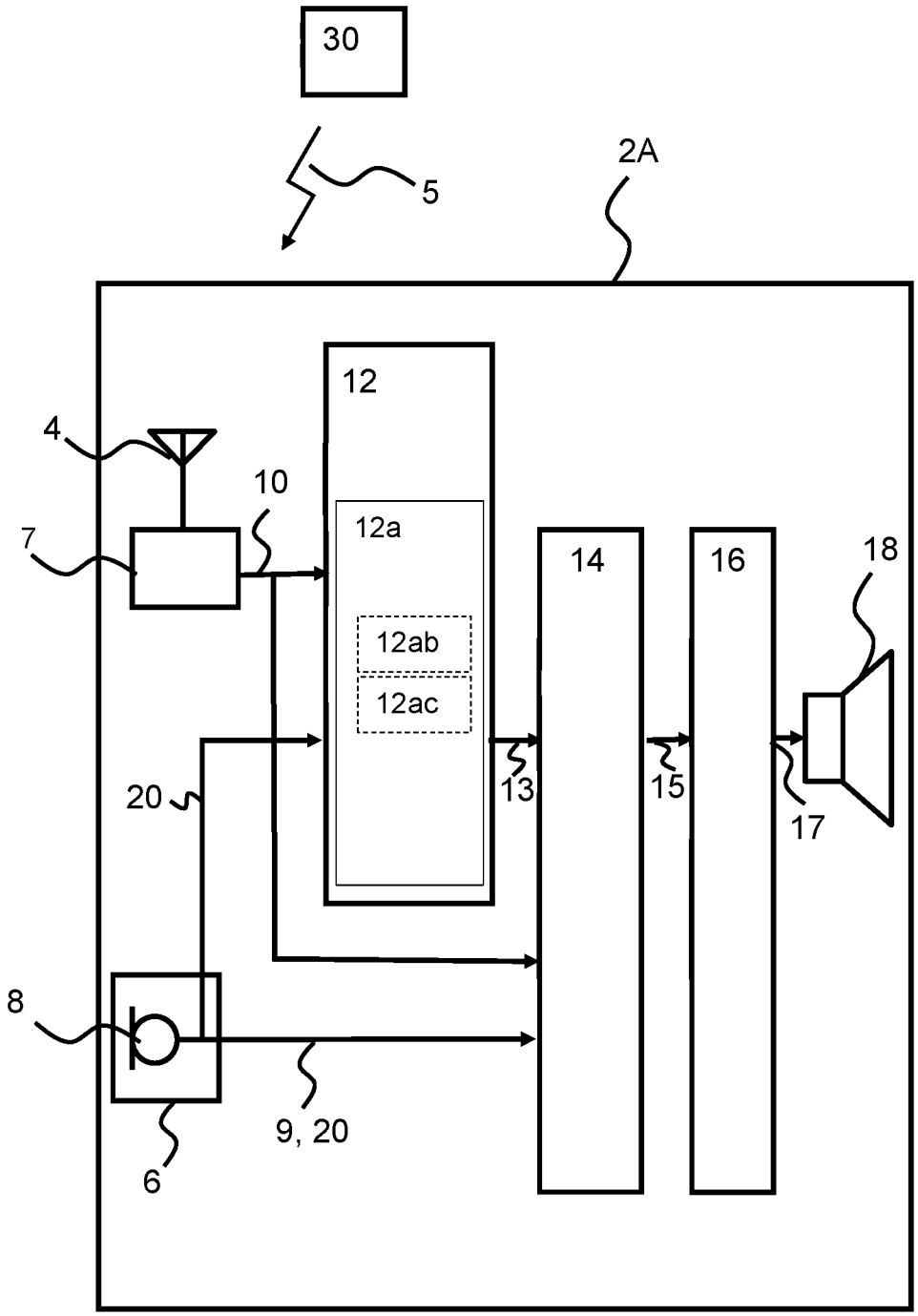

FIG. 2 is a block diagram of an exemplary hearing device 2A according to the disclosure wherein the first controller input signal 20 is a first input signal 9, 20. The hearing device 2A comprises a controller 12. The controller 12 is operatively connected to radio transceiver 7 and to the input unit 6. The controller 12 is configured to estimate the speech intelligibility indicator indicative of speech intelligibility based on the transceiver input signal 10 (e.g. a streamed sound signal from the external device) and a first input signal 9, 20 (e.g. an acoustic signal from the microphone). The controller 12 comprises a speech intelligibility estimator 12*a* for estimating a speech intelligibility indicator based on the transceiver input signal 10 and the first input signal 9, 20. The speech intelligibility estimator 12*a* is configured to estimate the speech intelligibility indicator by comparing the transceiver input signal 10 and the first input signal 9, 20. The transceiver input signal 10 serves as the clean reference signal (as it originates from the first wireless input signal) while the first input signal 9, 20 serves as the noisy speech signal. The speech intelligibility estimator 12*a* may be configured to compare the transceiver input signal 10 and the first input signal 9, 20 based on a modulation of the transceiver input signal 10 and a modulation of the first input signal 9, 20. The speech intelligibility estimator 12*a* may be configured to compare the transceiver input signal 10 and the first input signal 9, 20 based on a correlation between one or more spectral and/or temporal representations of the transceiver input signal 10 and one or more spectral and/or temporal representations of the first input signal 9, 20. The speech intelligibility estimator 12*a* may be configured to estimate the speech intelligibility indicator using a short-time objective intelligibility estimator 12*ac*. The short-time objective intelligibility estimator 12*ac* is configured to compare the transceiver input signal 10 and the first input signal 9, 20 in one or more short time segments, such as by deriving a correlation coefficient between temporal envelops of the transceiver input signal 10 and of the first input signal 9, 20 in short-time overlapping segments.

The controller 12 is configured to provide a controller output signal 13 based on the speech intelligibility indicator estimated by the speech intelligibility estimator 12*a*.

The pre-processor 14 is configured to apply, based on the controller output signal 13, a pre-processing scheme to the first input signal 9 and the transceiver input signal 10.

Figure 3:
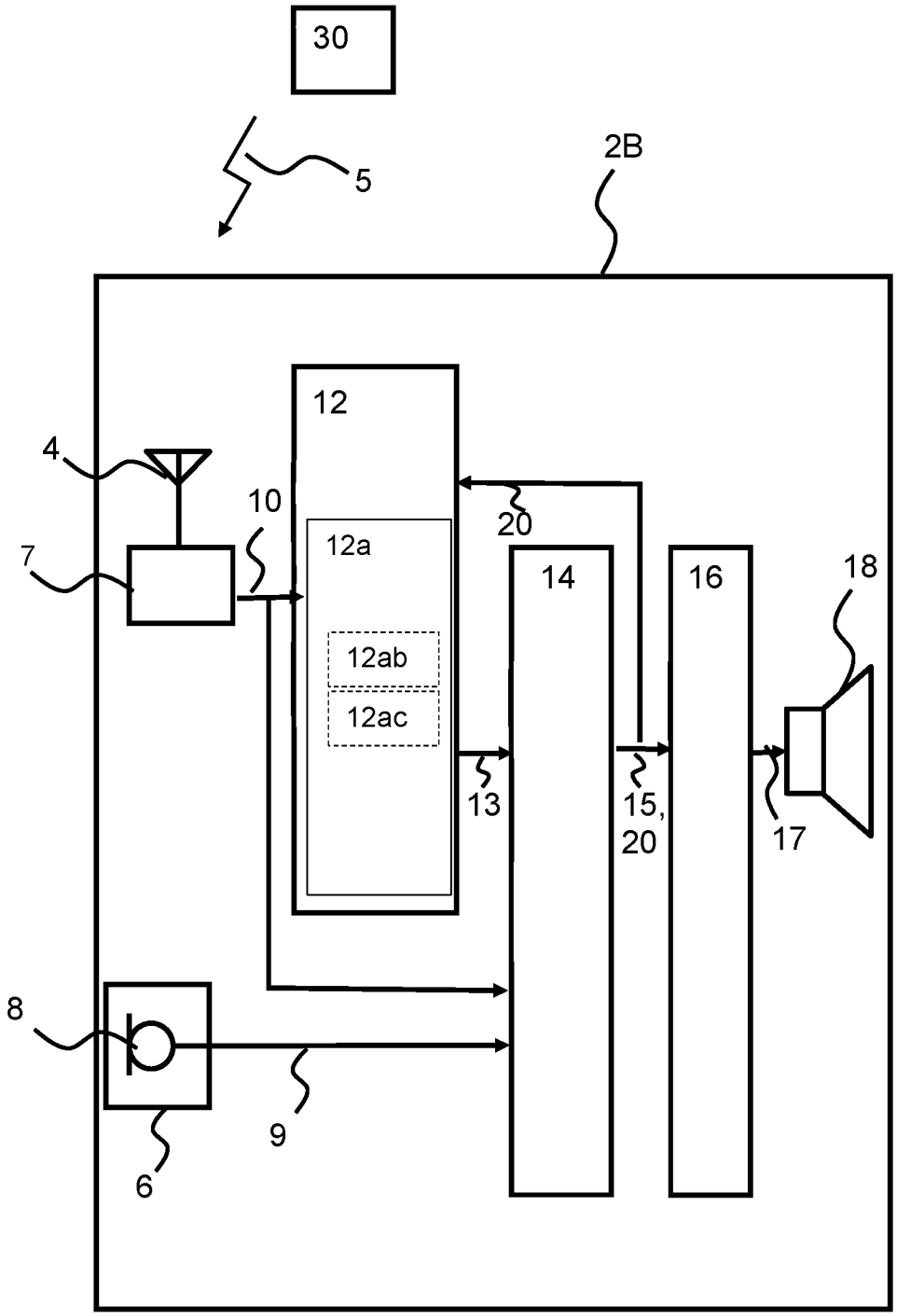

FIG. 3 is a block diagram of an exemplary hearing device 2B according to the disclosure wherein the first controller input signal 20 is a pre-processor output signal 15, 20. The hearing device 2B comprises a controller 12. The controller 12 is operatively connected to radio transceiver 7 and to the pre-processor 14. The controller 12 is configured to estimate the speech intelligibility indicator indicative of speech intelligibility based on the transceiver input signal 10 and a pre-processor output signal 15, 20. The controller 12 comprises a speech intelligibility estimator 12*a* for estimating a speech intelligibility indicator based on the transceiver input signal 10 and the pre-processor output signal 15, 20. The speech intelligibility estimator 12*a* is configured to estimate the speech intelligibility indicator by comparing the transceiver input signal 10 and the pre-processor output signal 15, 20. The transceiver input signal 10 serves as the clean reference signal (as it originates from the first wireless input signal) while the pre-processor output signal 15, 20 serves as the noisy speech signal. In other words, the speech intelligibility indicator is estimated based on the transceiver signal (e.g. the streamed sound signal from the external device) and the mixed signal outputted by the pre-processor (i.e. a mixture of the transceiver input signal and the first input signal) The speech intelligibility estimator 12*a* may be configured to compare the transceiver input signal 10 and the pre-processor output signal 15, 20 based on a modulation of the transceiver input signal 10 and a modulation of the pre-processor output signal 15, 20. The speech intelligibility estimator 12*a* may be configured to compare the transceiver input signal 10 and the pre-processor output signal 15, 20 based on a correlation between one or more spectral and/or temporal representations of the transceiver input signal 10 and one or more spectral and/or temporal representations of the pre-processor output signal 15, 20. The speech intelligibility estimator 12*a* may be configured to estimate the speech intelligibility indicator using a short-time objective intelligibility estimator 12*ac*. The short-time objective intelligibility estimator 12*ac* is configured to compare the transceiver input signal 10 and the pre-processor output signal 15, 20 in one or more short time segments, such as by deriving a correlation coefficient between temporal envelops of the transceiver input signal 10 and of the pre-processor output signal 15, 20 in short-time overlapping segments.

The controller 12 is configured to provide a controller output signal 13 based on the speech intelligibility indicator estimated by the speech intelligibility estimator.

The pre-processor 14 is configured to apply, based on the controller output signal 13, a pre-processing scheme to the first input signal 9 and the transceiver input signal 10. Estimating the speech intelligibility based the transceiver input signal 10 and the pre-processor output signal 15, 20 results in an increased reliability and precision in estimating the speech intelligibility.

Figure 4:
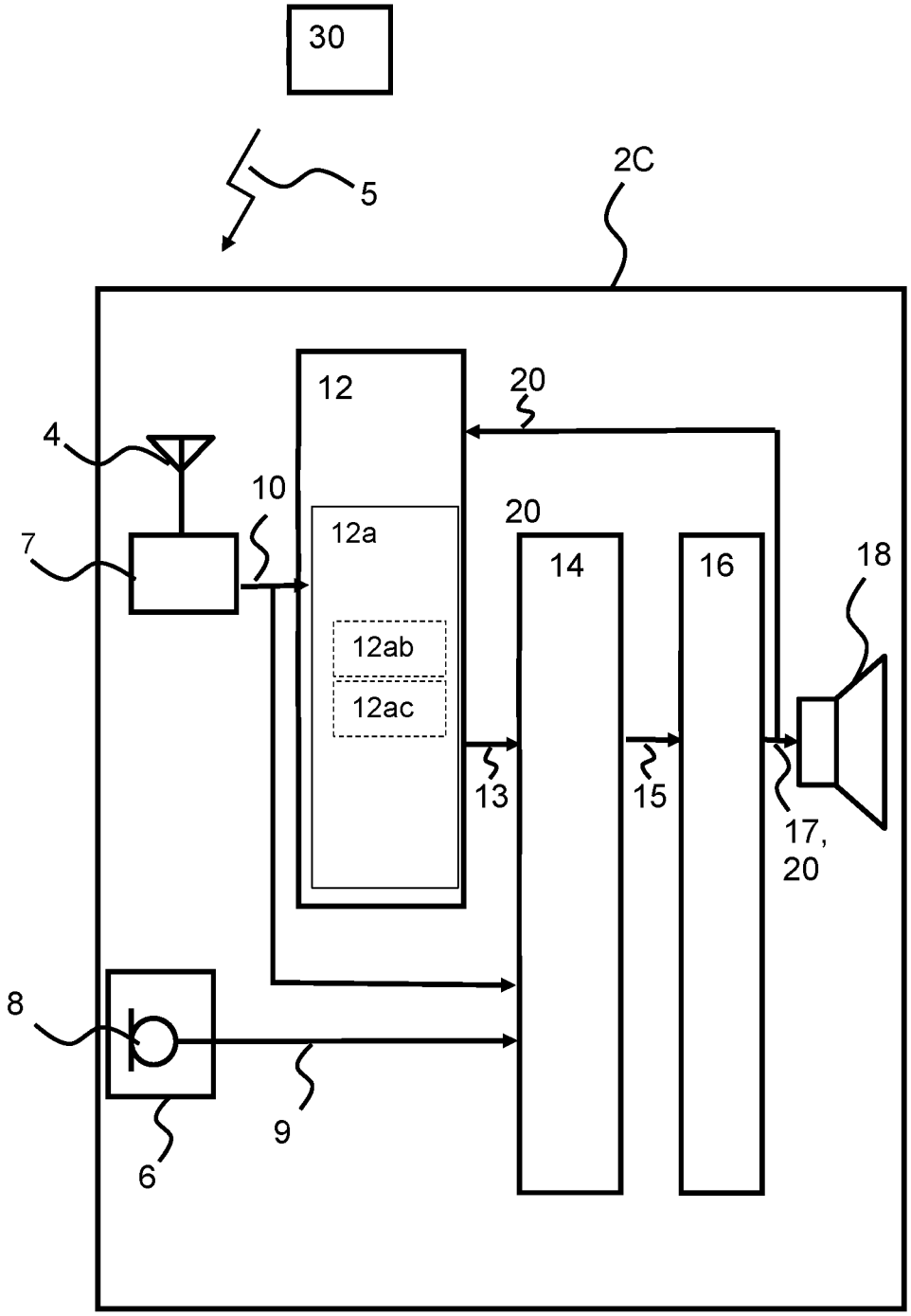

FIG. 4 is a block diagram of an exemplary hearing device 2C according to the disclosure, wherein the first controller input signal 20 is a processor output signal 17, 20. The hearing device 2C comprises a controller 12. The controller 12 is operatively connected to radio transceiver 7 and to the pre-processor 14. The controller 12 is configured to estimate the speech intelligibility indicator indicative of speech intelligibility based on the transceiver input signal 10 and a processor output signal 17, 20. The controller 12 comprises a speech intelligibility estimator 12*a* for estimating a speech intelligibility indicator based on the transceiver input signal 10 and the processor output signal 17, 20. The speech intelligibility estimator 12*a* is configured to estimate the speech intelligibility indicator by comparing the transceiver input signal 10 and the processor output signal 17, 20. The transceiver input signal 10 serves as the clean reference signal (as it originates from the first wireless input signal) while the processor output signal 17, 20 serves as the noisy speech signal. The speech intelligibility estimator 12*a* may be configured to compare the transceiver input signal 10 and the processor output signal 17, 20 based on a modulation of the transceiver input signal 10 and a modulation of the processor output signal 17, 20. The speech intelligibility estimator 12*a* may be configured to compare the transceiver input signal 10 and the processor output signal 17, 20 based on a correlation between one or more spectral and/or temporal representations of the transceiver input signal 10 and one or more spectral and/or temporal representations of the processor output signal 17, 20. The speech intelligibility estimator 12*a* may be configured to estimate the speech intelligibility indicator using a short-time objective intelligibility estimator 12*ac*. The short-time objective intelligibility estimator 12*ac* is configured to compare the transceiver input signal 10 and the processor output signal 17, 20 in one or more short time segments, such as by deriving a correlation coefficient between temporal envelops of the transceiver input signal 10 and of the processor output signal 17, 20 in short-time overlapping segments.

The controller 12 is configured to provide a controller output signal 13 based on the speech intelligibility indicator estimated by the speech intelligibility estimator. The pre-processor 14 is configured to apply, based on the controller output signal 13, a pre-processing scheme to the first input signal 9 and the transceiver input signal 10.

Figure 5:
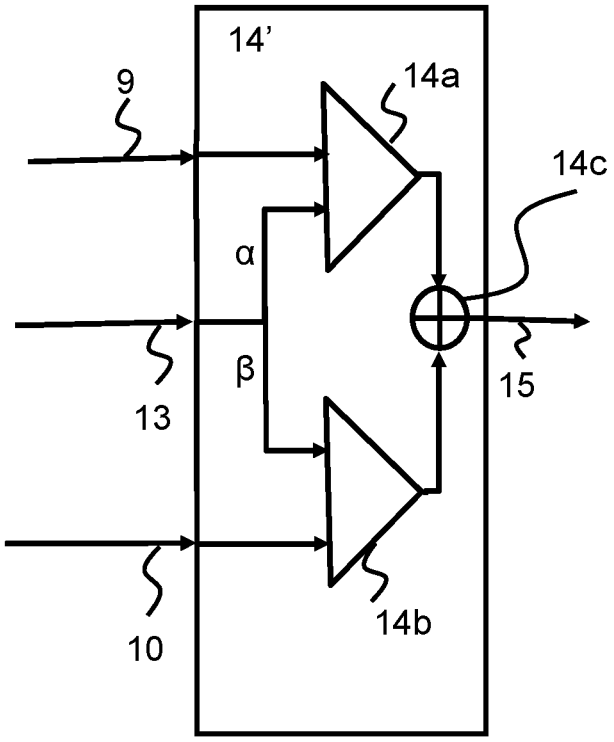
FIG. 5 is a block diagram illustrating an exemplary pre-processor according to the disclosure, wherein the pre-processor comprises a first gain control module and a second gain control module.

FIG. 5 is a block diagram illustrating an exemplary pre-processor 14' according to the disclosure, wherein the pre-processor 14' comprises a first gain control module 14*a* and a second gain control module 14*b*. The pre-processor 14' is configured to pre-process at least one of the first input signal 9 and the transceiver input signal 10. The pre-processor 14' is configured to receive a controller output signal 13 comprising one or more first gain parameters and one or more second gain parameters. The pre-processor 14's is configured to apply, based on the controller output signal 13, a pre-processing scheme to the first input signal 9 and the transceiver input signal 10. In other words, the pre-processor 14' controls the gain of the first input signal 9 and of the transceiver input signal 10 based on the controller input signal 13.

In the example shown in FIG. 5, the controller output signal 13 comprises a first broadband gain $\alpha$ and a second broadband gain $\beta$. The broadband gain $\alpha$ and the second broadband gain $\beta$ are derived in the controller by measuring the speech intelligibility. In one or more exemplary hearing devices, the pre-processor 14' is configured to apply the first gain parameter $\alpha$ to the first input signal 9 and the second gain parameter $\beta$ to the transceiver input signal 10. The pre-processor 14' comprises a first gain control module 14*a* and a second gain control module 14*b*. The pre-processor 14's is configured to apply the first broadband gain $\alpha$ to the first input signal 9 using the first gain control module 14*a*. The pre-processor 14's is configured to apply the second broadband gain $\beta$ to the transceiver input signal 10 using the second gain control module 14*b*. It may be envisaged that the second gain parameter $\beta$ and the first gain parameter $\alpha$ are related in that e.g. $\beta=1-\alpha$. The pre-processor 14' comprises a mixer module 14*c* that is configured to mix the signal provided by the first gain control module 14*a* and the signal provided by the second gain control module 14*b* for provision of the pre-processor output signal 15.

Figure 6:
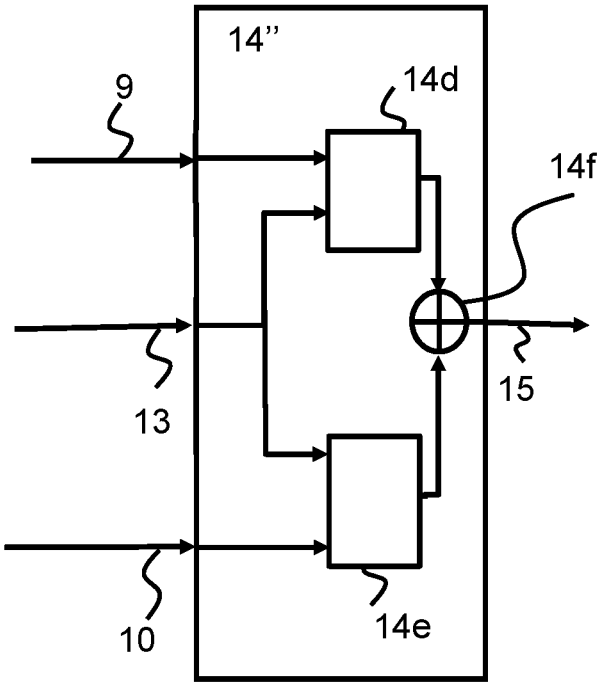
FIG. 6 is a block diagram illustrating an exemplary pre-processor according to the disclosure, wherein the pre-processor comprises a first filter and a second filter.

FIG. 6 is a block diagram illustrating an exemplary pre-processor 14" according to the disclosure, wherein the pre-processor 14" comprises a first filter 14*d* and a second filter 14*e*.

The pre-processor 14" is configured to pre-process at least one of the first input signal 9 and the transceiver input signal 10. The pre-processor 14' is configured to receive a controller output signal 13 comprising one or more first gain parameters and one or more second gain parameters. The pre-processor 14's is configured to apply, based on the controller output signal 13, a pre-processing scheme to the first input signal 9 and the transceiver input signal 10. The controller output signal 13 is indicative of the pre-processing scheme.

In the example shown in FIG. 6, the pre-processor 14" comprises a first filter 14*d* for filtering the first input signal 9 and a second filter 14*e* for filtering the transceiver input signal 10. For example, the first filter 14*d* and/or the second filter 14*e* may be adaptive filters. The one or more first gain parameters of the controller output signal 13 comprise a first set of filter coefficients. The one or more second gain parameters of the controller output signal 13 comprise a second set of filter coefficients. The pre-processor 14" is configured to apply a pre-processing scheme by applying the first set of filter coefficients in the first filter 14*d*. The pre-processor 14" is configured to apply a pre-processing scheme by applying the second set of filter coefficients in the second filter 14*e*. The pre-processor 14" comprises a mixer module 14*f* that is configured to mix the signal provided by the first filter 14*d* and the signal provided by the second filter 14*e* for provision of the pre-processor output signal 15. An exemplary hearing device comprising the pre-processor 14" is capable of frequency shaping the first input signal and the transceiver input signal to optimize the intelligibility of the mixture of the first input signal and the transceiver input signal. Simply put, this makes it possible to frequency shape the acoustic sound signal captured by the microphone and the streamed sound signal from the external device to optimize the intelligibility of the mixture.

Figure 7:
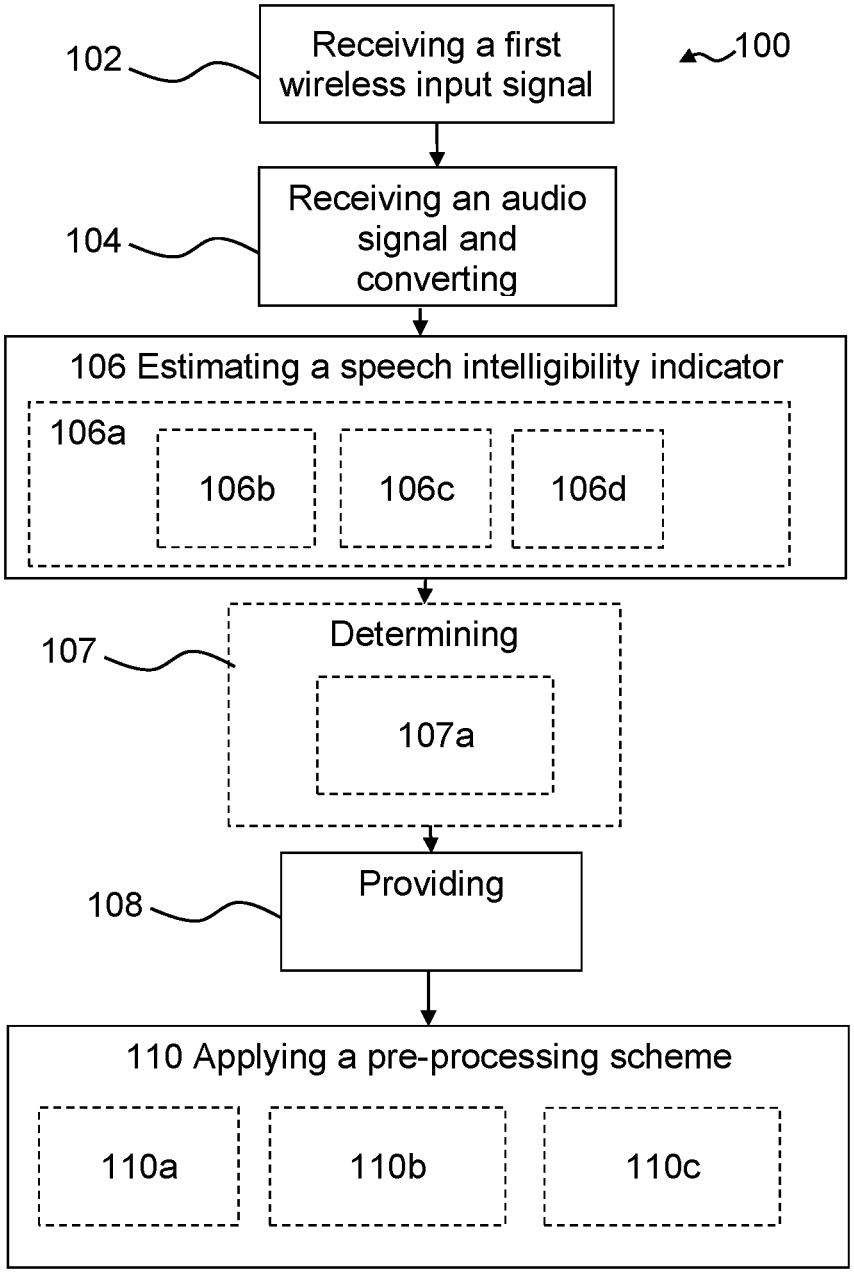
FIG. 7 is a flow diagram of an exemplary method for operating a hearing device according to the disclosure.

FIG. 7 is a flow diagram of an exemplary method 100 of operating a hearing device according to the disclosure. The method 100 of operating a hearing device may be performed in a hearing device or in a hearing system according to this disclosure. The method 100 comprises receiving 102, e.g. at an antenna of the hearing device, a first wireless input signal from an external device and converting, e.g. at a radio transceiver of the hearing device, the first wireless input signal to a transceiver input signal.

The method 100 comprises receiving 104, e.g. at an input module of the hearing device, an audio signal and converting the audio signal to one or more input signals including a first input signal.

The method comprises estimating 106 a speech intelligibility indicator indicative of speech intelligibility based on the transceiver input signal and a first controller input signal. Estimating 106 a speech intelligibility indicator may be performed at a speech intelligibility estimator of the hearing device and/or at a controller of the hearing device. In one or more exemplary methods, the first controller input signal is the first input signal. For example, estimating 106 the speech intelligibility indicator may be performed based on the transceiver input signal and the first input signal. In one or more exemplary methods, the first controller input signal is the pre-processor output signal. For example, estimating 106 the speech intelligibility indicator may be performed based on the transceiver input signal and the pre-processor output signal. In one or more exemplary methods, the first controller input signal is the processor output signal. For example, estimating 106 the speech intelligibility indicator may be performed based on the transceiver input signal and the processor output signal.

The method comprises providing 108 a controller output signal based on the speech intelligibility indicator, such as providing 108 controller output signal from a controller of the hearing device to a pre-processor of the hearing device.

The method comprises applying 110, based on the controller output signal, a pre-processing scheme to at least one of the first input signal and the transceiver input signal. Applying 110 the pre-processing scheme to at least one of the first input signal and the transceiver input signal may be performed at a pre-processor of the hearing device. In one or more exemplary methods, applying 110, based on the controller output signal, the pre-processing scheme to at least one of the first input signal and the transceiver input signal comprises applying 110*a*, based on the controller output signal, the pre-processing scheme to the first input signal and the transceiver input signal.

In one or more exemplary methods, estimating 106 the speech intelligibility indicator comprises comparing 106*a* the transceiver input signal and the first controller input signal. For example, comparing 106*a* the transceiver input signal and the first controller input signal may be performed based on a modulation 106*b* of the transceiver input signal and a modulation of the first controller input signal. For example, comparing 106*a* the transceiver input signal and the first controller input signal may comprise determining 106*c* a correlation between one or more spectral and/or temporal representations of the transceiver input signal and one or more spectral and/or temporal representations of the first controller input signal.

In one or more exemplary methods, comparing 106*a* the transceiver input signal and the first controller input signal is performed using 106*d* a short-time objective intelligibility estimator, wherein the short-time objective intelligibility estimator is configured to compare the transceiver input signal and the first controller input signal in one or more short time segments. For example, comparing 106*d* the transceiver input signal and the first controller input signal in one or more short time segments may comprise deriving a correlation coefficient between temporal envelops of the transceiver input signal and of the first controller input signal (e.g. the first input signal, the pre-processor output signal, or the processor output signal) in short-time overlapping segments.

In one or more exemplary methods, the method 100 comprises determining 107 the pre-processing scheme based on the speech intelligibility indicator. Determining 107 the pre-processing scheme based on the speech intelligibility indicator may be performed at the controller module of the hearing device. For example, determining 107 the pre-processing scheme based on the speech intelligibility indicator may comprise determining 107*a* one or more first gain parameters of the pre-processing scheme and one or more second gain parameter of the pre-processing scheme. The controller output signal may comprise the one or more first gain parameters of the pre-processing scheme and the one or more second gain parameter of the pre-processing scheme. The controller output signal is indicative of the pre-processing scheme selected. For example, the one or more first gain parameters may comprise a broadband first gain and the one or more second gain parameters may comprise a broadband second gain.

In one or more exemplary methods, applying 110, based on the controller output signal, a pre-processing scheme to the first input signal and the transceiver input signal comprises 110*b*: applying the one or more first gain parameters to the first input signal and applying the one or more second gain parameters to the transceiver input signal.

In one or more exemplary methods, applying 110, based on the controller output signal, a pre-processing scheme to the first input signal and the transceiver input signal comprises 110*c*: filtering the first input signal and filtering the transceiver input signal. For example, filtering the first input signal may be performed at a first filter and filtering the transceiver input signal may be performed at a second filter over vice versa. In one or more exemplary methods, the one or more first gain parameters comprise a first set of filter coefficients and the one or more second gain parameters comprise a second set of filter coefficients. For example, the controller output signal may comprise the first set of filter coefficients and/or the second set of filter coefficients.

The hearing devices, and methods discloses herein allow to obtain an estimation of the speech intelligibility indicator and adaptation of the pre-processing applied to the input signals and to the transceiver input signals according to the estimated speech intelligibility indicator. This provides the advantage of adapting the processing of the transceiver input signal (e.g. signal from the one or more external/spouse microphone devices) with the input signal from the one or more microphones. For example, the present disclosure advantageously enables the hearing device to attenuate the input signals at an optimal level. It is an advantage of this disclosure to prevent the hearing device user to be disconnected from the audio environment while still being able to understand the speech received via the transceiver input signal from the external device.

The use of the terms "first", "second", "third" and "fourth", etc. does not imply any particular order, but are included to identify individual elements. Moreover, the use of the terms first, second, etc. does not denote any order or importance, but rather the terms first, second, etc. are used to distinguish one element from another. Note that the words first and second are used here and elsewhere for labelling purposes only and are not intended to denote any specific spatial or temporal ordering. Furthermore, the labelling of a first element does not imply the presence of a second element and vice versa.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

2 hearing device
2A hearing device
2B hearing device
2C hearing device
4 antenna
5 first wireless input signal
6 input module
7 radio transceiver
8 first microphone
9 first input signal
10 transceiver input signal
12 controller
12*a* speech intelligibility estimator
12*ab* comparator module
12*ac* short-time objective intelligibility estimator
13 controller output signal
14, 14', 14" pre-processor
14*a* first gain control module
14*b* second gain control module
14*c*, 14*f* mixer module
14*d* first filter
14*e* second filter
15 pre-processor output signal
16 processor
17 processor output signal
18 receiver
20 first controller input signal
30 external device
100 method of operating a hearing device
102 receiving a first wireless input signal
104 receiving an audio signal and converting
106 estimating a speech intelligibility indicator
106*a* comparing the transceiver input signal and the first controller input signal
106*b* comparing a modulation of the transceiver input signal and a modulation of the first controller input signal
106*c* determining a correlation between one or more spectral and/or temporal representations of the transceiver input signal and one or more spectral and/or temporal representations of the first controller input signal
106*d* comparing the transceiver input signal and the first controller input signal in one or more short time segments
107 determining the pre-processing scheme based on the speech intelligibility indicator

The invention claimed is:

1. A hearing device comprising:

an antenna for receiving a first wireless input signal from an external device;

a transceiver coupled to the antenna, the transceiver configured to provide a transceiver input signal, the transceiver input signal being based on the first wireless input signal;

an input module for provision of a first input signal, the input module comprising a first microphone, wherein the first input signal comprises a microphone signal;

a first processing unit configured to provide a processed output signal;

a receiver configured to provide an audio output signal based on the processed output signal;

a second processing unit, operatively connected to the input module and to the transceiver, for provision of a pre-processing output signal based on the first input signal; and a controller, operatively connected to the transceiver, the controller of the hearing device comprising a speech intelligibility estimator for determining a speech intelligibility indicator indicative of speech intelligibility based on the transceiver input signal, wherein the controller is configured to provide a controller output signal based on the speech intelligibility indicator;

wherein the second processing unit is configured to apply, based on the controller output signal, a processing scheme to the first input signal, to the transceiver input signal, or to both of the first input signal and the transceiver input signal, and wherein the second processing unit is configured to provide a mixed output signal based on both of the microphone signal and the transceiver input signal; and wherein the transceiver input signal comprises a digital audio signal that is based on the first wireless input signal, and wherein the hearing device is configured to process the digital audio signal to improve a listening experience for a user of the hearing device.

2. The hearing device according to claim 1, wherein the speech intelligibility estimator is configured to determine the speech intelligibility indicator also based on the first input signal.

3. The hearing device according to claim 1, wherein the speech intelligibility estimator is configured to determine the speech intelligibility indicator also based on the pre-processing output signal.

4. The hearing device according to claim 1, wherein the speech intelligibility estimator is configured to determine the speech intelligibility indicator also based on the processed output signal.

5. The hearing device according to claim 1, wherein the speech intelligibility estimator is configured to determine the speech intelligibility indicator by comparing the transceiver input signal and a first controller input signal.

6. The hearing device according to claim 5, wherein the speech intelligibility estimator is configured to compare the transceiver input signal and the first controller input signal based on a modulation of the transceiver input signal and a modulation of the first controller input signal.

7. The hearing device according to claim 5, wherein the speech intelligibility estimator is configured to compare the transceiver input signal and the first controller input signal based on a correlation between one or more spectral and/or temporal representations of the transceiver input signal and one or more spectral and/or temporal representations of the first controller input signal.

8. The hearing device according to claim 5, wherein the speech intelligibility estimator is configured to determine the speech intelligibility indicator using a short-time objective intelligibility estimator, wherein the short-time objective intelligibility estimator is configured to compare the transceiver input signal and the first controller input signal in one or more short time segments.

9. The hearing device according to claim 5, wherein the controller is configured to receive the first controller input signal from inside the hearing device.

10. The hearing device according to claim 5, wherein the first controller input signal comprises the first input signal, the pre-processing output signal, or the processed output signal.

11. The hearing device according to claim 1, wherein the controller is configured to determine the processing scheme based on the speech intelligibility indicator.

12. The hearing device according to claim 1, wherein the controller is configured to determine the processing scheme by determining one or more first gain parameter(s) of the processing scheme and one or more second gain parameter(s) of the processing scheme.

13. The hearing device according to claim 12, wherein the second processing unit is configured to apply the processing scheme by applying the one or more first gain parameter(s) to the first input signal, and applying the one or more second gain parameter(s) to the transceiver input signal.

14. The hearing device according to claim 12, wherein the one or more first gain parameter(s) comprise a first set of filter coefficients, and the one or more second gain parameter(s) comprise a second set of filter coefficients.

15. The hearing device according to claim 12, wherein the controller is configured to determine the one or more first gain parameter(s) and the one or more second gain parameter(s) based on the speech intelligibility indicator.

16. The hearing device according to claim 1, wherein the controller is configured to determine the speech intelligibility indicator for one or each of a plurality of frequency bands, and generate one or more first frequency dependent gain parameter(s) and one or more second frequency dependent gain parameter(s) based on the speech intelligibility indicator for the one or each of the plurality of frequency bands.

17. The hearing device according to claim 1, wherein the external device is a spouse microphone device, and wherein the transceiver input signal is a speech sound signal from the spouse microphone device.

18. The hearing device according to claim 1, wherein the second processing unit is configured for provision of the pre-processing output signal based also on the transceiver input signal.

19. The hearing device according to claim 1, wherein the second processing unit is communicatively coupled between the controller and the first processing unit.

20. The hearing device according to claim 1, wherein the controller is communicatively coupled between the transceiver and the second processing unit.

21. The hearing device according to claim 1, wherein the hearing device is a hearing aid, and wherein the hearing aid is configured to determine the speech intelligibility indicator based on the digital audio signal provided by the transceiver of the hearing aid.

22. The hearing device according to claim 21, wherein the hearing aid is configured to determine the speech intelligibility indicator while the hearing aid is being worn by a user for compensating hearing loss of the user.

23. The hearing device according to claim 1, wherein the hearing device is configured to determine the speech intelligibility indicator while the hearing device is being worn by a user.

24. The hearing device according to claim 1, wherein the speech intelligibility indicator is based on the digital audio signal provided by the transceiver of the hearing device.

25. The hearing device according to claim 1, wherein the first processing unit and the second processing unit are configured to perform different respective functions, and wherein the first processing unit is configured to perform signal processing for hearing loss compensation.

26. A method performed by a hearing device, the method comprising:

receiving, by an antenna, a first wireless input signal from an external device;

providing, by a transceiver, a transceiver input signal based on the first wireless input signal;

receiving an audio signal by an input module;

providing one or more input signals by the input module, the one or more input signals comprise a first input signal, wherein the first input signal comprises a microphone signal;

determining, by the hearing device, a speech intelligibility indicator indicative of speech intelligibility based on the transceiver input signal;

providing a controller output signal based on the speech intelligibility indicator;

applying, based on the controller output signal, a processing scheme to the first input signal, to the transceiver input signal, or to both;

providing a mixed output signal based on both of the microphone signal and the transceiver input signal;

providing a processed output signal by a first processing unit; and providing an audio output signal by a receiver based on the processed output signal;

wherein the transceiver input signal comprises a digital audio signal that is based on the first wireless input signal, and wherein the digital audio signal is processed by the hearing device to improve a listening experience for a user of the hearing device.

27. The method according to claim 26, wherein the speech intelligibility indicator is determined also based on a first controller input signal.

28. The method according to claim 27, wherein the first controller input signal is transmitted from a component in the hearing device to a controller in the hearing device.

29. The method according to claim 28, further comprising a first processing unit, wherein the controller is communicatively coupled between the transceiver and a second processing unit.

30. The method according to claim 29, wherein the second processing unit is communicatively coupled between the controller and the first processing unit.

31. The method according to claim 26, wherein the hearing device is a hearing aid, and wherein the speech intelligibility indicator is determined by the hearing aid based on the digital audio signal provided by the transceiver of the hearing aid.

32. The method according to claim 31, wherein the speech intelligibility indicator is determined by the hearing aid while the hearing aid is being worn by a user for compensating hearing loss of the user.

33. The method according to claim 26, wherein the speech intelligibility indicator is determined by the hearing device while the hearing device is being worn by a user.

34. The method according to claim 26, wherein the speech intelligibility indicator is determined also based on the first input signal.

35. The method according to claim 26, wherein the speech intelligibility indicator is determined by the hearing device based on the digital audio signal provided by the transceiver of the hearing device.

* * * * *